US009694511B2

(12) United States Patent
Sladojevic

(10) Patent No.: US 9,694,511 B2
(45) Date of Patent: Jul. 4, 2017

(54) SIDEFORM SECURING SYSTEM

(75) Inventor: Robert Sladojevic, Kent Town (AU)

(73) Assignee: Pre-Form Systems Doo, Temerin (RS)

( * ) Notice: Subject to any disclaimer, the term of this patent is extended or adjusted under 35 U.S.C. 154(b) by 1482 days.

(21) Appl. No.: 12/514,229

(22) PCT Filed: Oct. 31, 2007

(86) PCT No.: PCT/AU2007/001655

§ 371 (c)(1),
(2), (4) Date: Jan. 6, 2010

(87) PCT Pub. No.: WO2008/058313

PCT Pub. Date: May 22, 2008

(65) Prior Publication Data

US 2010/0102198 A1 Apr. 29, 2010

(30) Foreign Application Priority Data

Nov. 14, 2006 (AU) ..... 2006906339

(51) Int. Cl.
*B28B 7/00* (2006.01)
*E04G 13/00* (2006.01)

(52) U.S. Cl.
CPC ..... *B28B 7/0017* (2013.01); *B28B 7/002* (2013.01); *E04G 13/00* (2013.01); *B28B 2007/0052* (2013.01)

(58) Field of Classification Search
CPC ..... B28B 7/0017; B28B 7/002; B28B 2007/0052
USPC ..... 249/2, 3, 4, 5, 6, 7, 139
See application file for complete search history.

(56) References Cited

U.S. PATENT DOCUMENTS

| | | | | |
|---|---|---|---|---|
| 1,382,082 | A * | 6/1921 | Heltzel et al. | 249/6 |
| 4,898,358 | A * | 2/1990 | Spronken | 249/7 |
| 5,076,536 | A * | 12/1991 | Fitzgerald | 249/219.1 |
| 5,205,942 | A * | 4/1993 | Fitzgerald | 249/3 |
| 5,234,654 | A * | 8/1993 | Brooks | 264/219 |
| 5,766,645 | A * | 6/1998 | Kaminski | 425/63 |
| 8,011,144 | B2 * | 9/2011 | Compton | 52/169.11 |
| 2005/0061948 | A1 * | 3/2005 | Brennan | 249/167 |

FOREIGN PATENT DOCUMENTS

| | | | |
|---|---|---|---|
| DE | 282 590 | A7 | 9/1990 |
| DE | 201 20 212 | U1 | 5/2003 |
| WO | 01/96690 | A1 | 12/2001 |
| WO | 2006/063399 | A1 | 6/2006 |

* cited by examiner

*Primary Examiner* — Michael Safavi
(74) *Attorney, Agent, or Firm* — Sughrue Mion, PLLC

(57) ABSTRACT

A sideform assembly (9) includes a sideform (11) defining an attaching formation (13', 14') on an operatively rear wall (12). A mounting bracket assembly (10) comprises a connector plate (16) for supporting the sideform (11) and includes an engaging component (21) for engaging the attaching formation (13', 14') of the sideform (11). A mounting member (18) is carried by the connector plate (16) for mounting the connector plate (16) to a substrate.

1 Claim, 4 Drawing Sheets

SIDEFORM SECURING SYSTEM

CROSS-REFERENCE TO RELATED APPLICATIONS

This application is a national phase application under 35 U.S.C. § 371 OF International Patent Application No. PCT/AU2007/001655 filed on Nov. 14, 2007 which claims the benefit of Australian Provisional Patent Application No 2006906339 filed on Nov. 14, 2006, the disclosures of which are incorporated herein by reference in their entirety.

FIELD OF THE INVENTION

This invention relates, generally, to securing a sideform to a substrate, in particular, to a sideform assembly used for supporting sideforms in their moulding locations in the manufacture of precast building panels.

BACKGROUND TO THE INVENTION

In Australian Patent No 721582 dated 28$^{th}$ April 1988 entitled "Method and Arrangement for Forming Construction Panels and Structures", there is disclosed an arrangement and system that can be used to construct concrete panels on a work site. The arrangement uses a series of sideforms which define a mould cavity for the panel to be cast, sliding risers to laterally support the sideforms, and set back buttresses to support the sliding risers relative to a work site. In use, the set back buttresses are set back from the sideforms, with the sliding risers being slidably supported, one on top of the other, by the buttresses. In use, the leading ends of the sliding risers are releasably secured to the sideforms in a manner which does not require the sideform to be moved. It will of course be appreciated that a sideform used for moulding large precast building panels can be quite long and is not suited to being readily moved.

While the above described formwork system is particularly suited to moulding multiple building panels, one on top of the other, there is a need for a simple and relatively inexpensive sideform support system, both for in situ and off-site moulding operations, where there is a requirement only for a single panel (e g one which is of an unusual or awkward shape and/size) to be moulded.

SUMMARY OF THE INVENTION

According to a first aspect of the invention, there is provided a sideform assembly which includes a sideform defining an attaching formation on an operatively rear wall; and a mounting bracket assembly comprising a connector plate for supporting the sideform and including an engaging means for engaging the attaching formation of the sideform; and a mounting member carried by the connector plate for mounting the connector plate to a substrate.

The sideform may be of box-section defining a moulding face arranged in spaced relationship relative to the operatively rear wall of the sideform.

The connector plate may carry, on its operatively front face, an abutting arrangement which abuts the rear wall of the sideform to support the sideform. The abutting arrangement may comprise a plurality of spaced ribs arranged on the front face of the connector plate. Preferably, the ribs extend transversely across the face of the connector plate.

A locating formation may be carried on an opposed face of the connector plate for locating the mounting member relative to the connector plate. The locating formation may be a flange extending outwardly from the connector plate against which a top of the mounting member abuts.

In an embodiment, the mounting member may comprise a mounting bracket. The mounting bracket may define a receiving formation through which a fastener is receivable for fastening the mounting bracket to the substrate.

In another embodiment, the mounting member may be a magnetisable mounting block for mounting to a magnetic substrate.

According to a second aspect of the invention there is provided a mounting bracket for a sideform assembly, the mounting bracket including a connector plate for supporting a sideform of the assembly, the connector plate including an engaging means for engaging an attaching formation of the sideform and an abutting arrangement which abuts a rear wall of the sideform to support the sideform, the engaging means and the abutting arrangement being carried on one side of the plate; and a mounting member carried on an opposed side of the connector plate for mounting the connector plate to a substrate.

BRIEF DESCRIPTION OF DRAWINGS

An embodiment of the invention is now described by way of example with reference to the accompanying drawings in which.

DETAILED DESCRIPTION OF EXEMPLARY EMBODIMENTS

Figure 2:
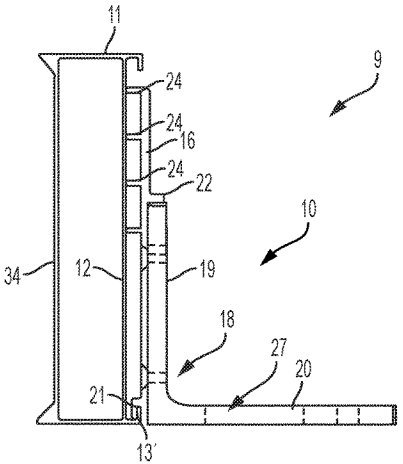
FIG. 2 shows a side view of the assembly of FIG. 1.
Figure 1:
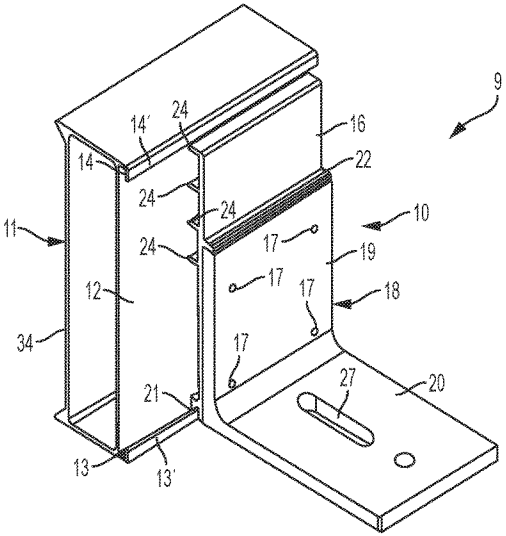
FIG. 1 shows a fragmentary, perspective view showing a portion of a first embodiment of a sideform assembly.
Figure 4:
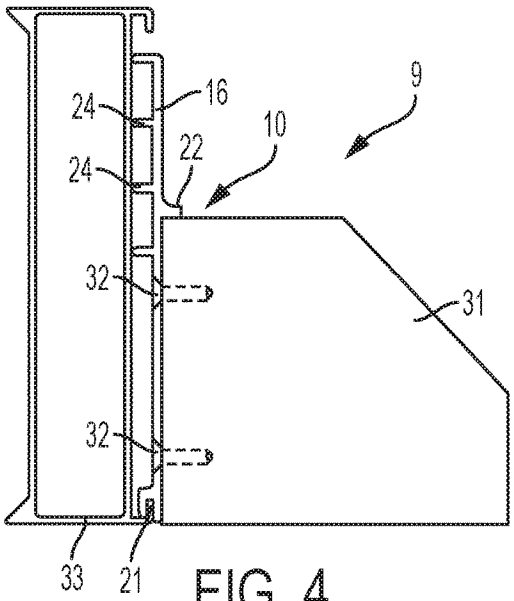
FIG. 4 shows a side view of the assembly of FIG. 3.
Figure 3:
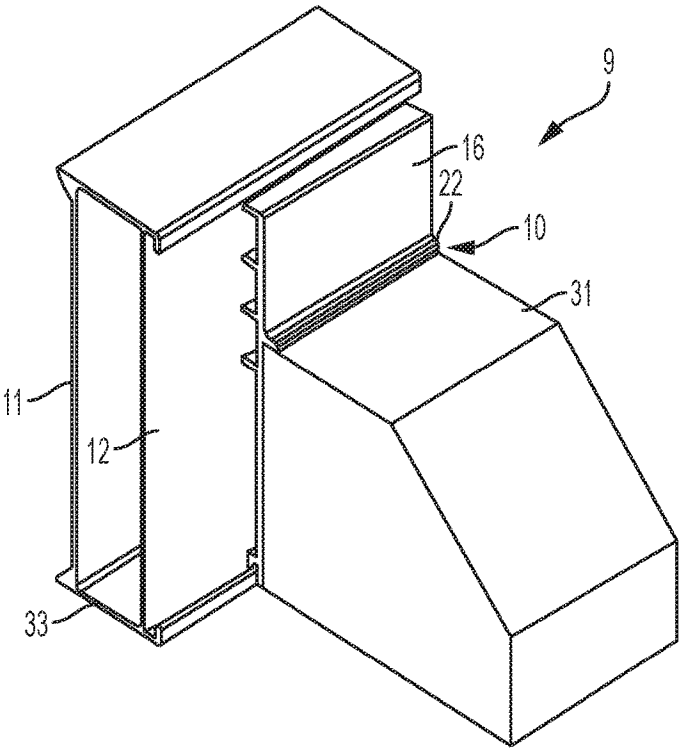
FIG. 3 shows a fragmentary, perspective view showing a portion of a second embodiment of a sideform assembly.

Referring to FIGS. 1 and 2 of the accompanying drawings, reference numeral 9 generally designates an embodiment of a sideform assembly. The sideform assembly 9 comprises a mounting bracket assembly 10, in accordance with an embodiment of the invention, releasably connected to an elongate box-like sideform 11 which is preferably made from extruded aluminium. The sideform 11 has a vertical planar rear wall 12 formed with two spaced, opposed longitudinally extending attaching formations in the form of channels 13, 14, each of which has a flange or lip 13', 14' spaced from, and extending parallel to, the rear wall 12. The sideform 11 has a front wall 34 against which concrete is moulded.

The mounting bracket assembly 10 comprises a vertical connector plate 16 removably attached by means of securing bolts or screws 17 to a mounting member which, in this embodiment, is an angle section support bracket 18. The bracket 18 has a vertical flange 19 and a horizontal flange, or foot, 20 which is arranged to be fastened to an underlying substrate which can be, for example, a concrete slab or a magnetic table.

The connector plate 16 is formed with an engaging means in the form of a bottom locking channel or groove 21 which extends transversely across the width of the plate 16, on an operatively front side of the plate 16, and releasably engages the inwardly directed lip or flange 13' on the sideform 11. When engaged, this serves to lock the bracket assembly 10 and the sideform 11 together. The connector plate 16 is also provided with an abutting arrangement in the form of a plurality of vertically spaced parallel transversely extending ribs 24 which project from the operatively front side of the plate 16. The ribs 24 bear against the rear wall 12 of the sideform 11 so as to impart lateral support to the sideform 11.

A rear side of the plate 16 carries a locating formation in the form of an outwardly extending, transversely arranged flange 22 which serves to locate and position the mounting member relative to the connector plate 16.

It will be appreciated that the vertical height of the plate 16 is slightly less than the height of a mouth formed between opposing free edges of the inwardly directed flanges 13', 14' on the sideform 11, to facilitate positioning of the plate 16 between the flanges 13' and 14'. The provision of multiple ribs 24 allows the plate 16 to be reduced in height to suit sideforms 11 of smaller height. This is done by simply cutting off an upper portion from the plate 16 so that its height is less than the length the mouth defined between the opposing flanges 13' and 14' on the sideform 11.

An elongate slot 27 is defined in the foot 20 of the bracket 18, a fastener (not shown) such as a bolt being receivable through the slot 27 to fasten the bracket assembly 10 to the substrate. In this embodiment, the substrate may be a concrete base. The slot 27 permits a degree of sliding movement of the sideform assembly 9 relative to the substrate. Such movement may be required to accommodate lateral expansion of the formwork during setting of the concrete in the mould.

Referring to FIGS. 3 to 6 of the drawings, a second embodiment of the sideform assembly 9 is illustrated. With reference to FIGS. 1 and 2 of the drawings, like reference numerals refer to like parts unless otherwise specified.

This embodiment illustrates a sideform assembly 9 suitable for use on a magnetic table 30 (FIG. 5) in a factory environment. The attachment of the connector plate 16 to the sideform 11 is exactly the same as that described and illustrated in the first embodiment. However, in this embodiment, the mounting member is a ferromagnetic metal block 31. The connector plate 16 of the bracket assembly 10 is secured to a top of the magnetic table 30 by means of the metal block 31 which is removably attached to the rear face of the vertical connector plate 16 by means of fastening screws or bolts 32. The metal block 31, when magnetised, securely locks the sideform assembly 9 to the table 30, whereupon concrete can be poured into the mould cavity defined by the sideforms.

Figure 5:
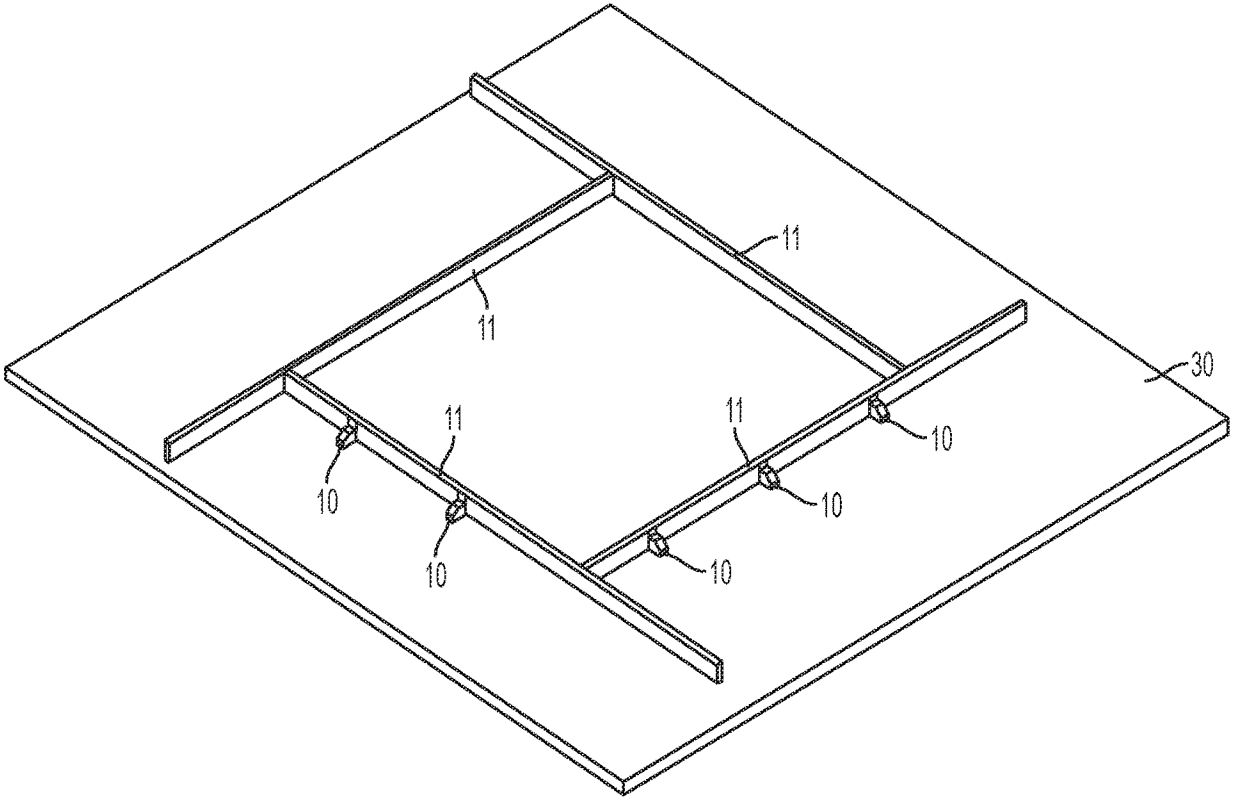
FIG. 5 shows a perspective view of a formwork system for moulding a concrete building panel on a horizontal magnetic table in a factory environment using the assembly of FIGS. 3 and 4.
Figure 6:
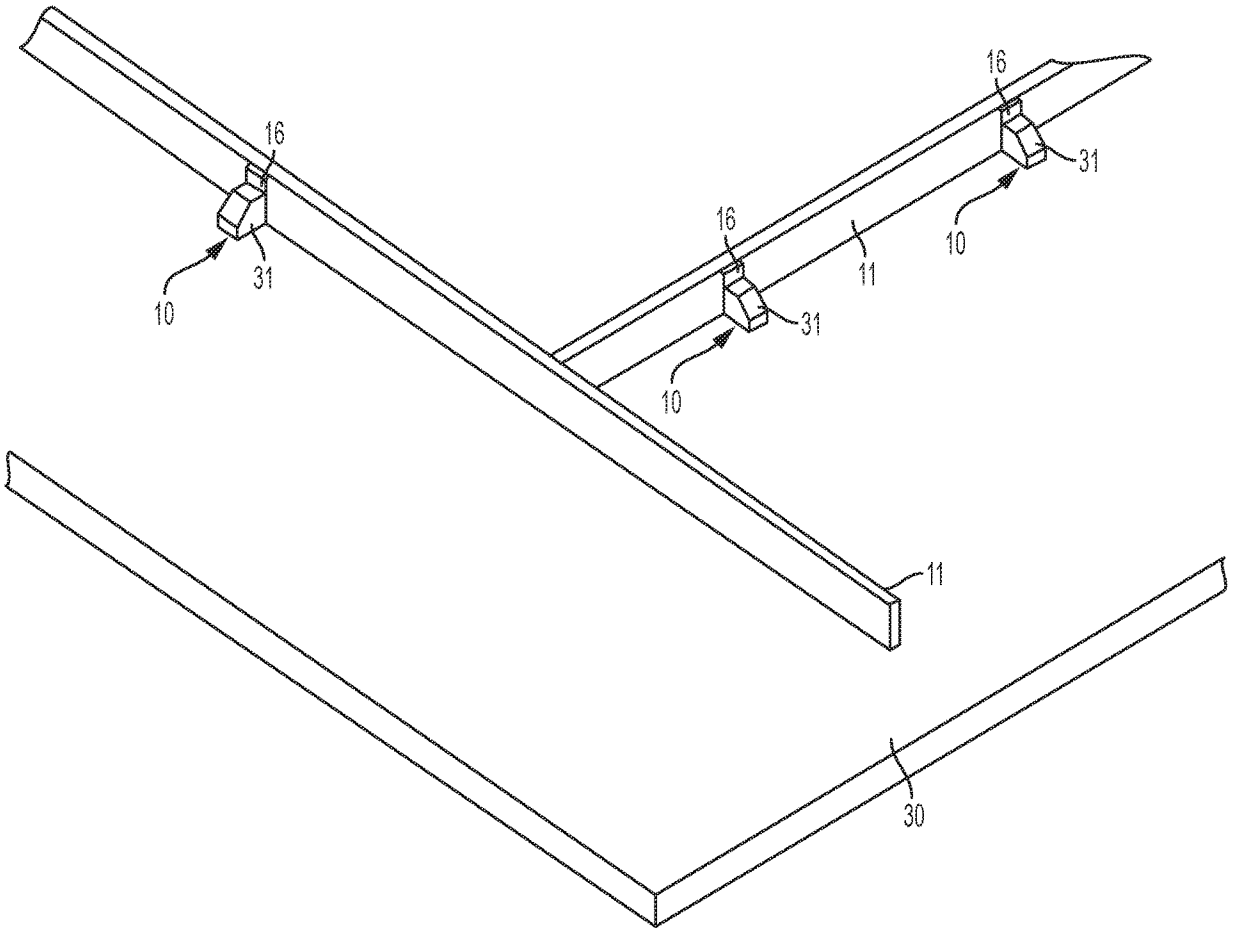
FIG. 6 shows a fragmentary, perspective view of a part of the formwork system of FIG. 5.

FIGS. 5 and 6 illustrate an array of sideforms 11 which together form a rectangular mould supported on top of the magnetic table 30. Once the concrete panel has sufficiently cured, the table 30 is demagnetised to thereby release the anchoring blocks 31 and in turn allow the sideforms 11 to be pulled away from the moulded panel.

It is an advantage of the invention that a sideform assembly 9 is provided which is simple and cost-effective to use, in particular, where only a single panel, which may be of an awkward shape, is required to be moulded. Also, due to the modular nature of the assembly 9, the assembly 9 can easily be modified to be used with on different types of substrates.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A sideform assembly which includes:

a sideform with a front wall and operatively rear wall defining an attaching formation on the operatively rear wall; and a mounting bracket assembly comprising a connector plate for supporting the sideform and including an engaging means for engaging the attaching formation of the sideform; and a mounting bracket carried by the connector plate for mounting the connector plate to a substrate, the mounting bracket defining a receiving formation through which a fastener is receivable for fastening the mounting bracket to the substrate;

wherein when the attaching formation and engaging means are engaged the sideform and mounting bracket assembly lock together.

* * * * *